US005986495A

United States Patent [19]

Chen

[11] Patent Number: 5,986,495

[45] Date of Patent: Nov. 16, 1999

[54] KEY SWITCH CONTROL DEVICE

[76] Inventor: Wen-Pin Chen, 7-F1, No. 339, Chung Cheng Rd., Pan Chiao, Taipei Hsien, Taiwan

[21] Appl. No.: 09/042,565

[22] Filed: Mar. 17, 1998

[51] Int. Cl.[6] ..... H01H 35/00

[52] U.S. Cl. ..... 327/447; 327/453; 307/125

[58] Field of Search ..... 327/428, 429, 327/440, 442, 447, 453, 454; 307/125, 126, 139, 140

[56] References Cited

U.S. PATENT DOCUMENTS 5,587,980 12/1996 Kablau et al. ..... 369/54

5,783,875 7/1998 Jaros ..... 307/116

5,800,264 9/1998 Pascal et al. ..... 463/16

*Primary Examiner*—Tuan T. Lam

*Attorney, Agent, or Firm*—Bacon & Thomas

[57] ABSTRACT

A key switch control device includes a gate controller and a load connected in series to AC power supply, a control circuit connected to the key switch to receive from it a pulse signal for controlling the gate controller and the load, enabling AC power supply to be connected to the load when the key switch is clicked once, or disconnected from the load when the key switch is clicked at least twice. The control circuit includes an oscillator, a time pulse counter, a periodic comparator, a power modulation recognizer, and an output drive.

7 Claims, 3 Drawing Sheets

KEY SWITCH CONTROL DEVICE

BACKGROUND OF THE INVENTION

The present invention relates to a key switch control device, and more particularly to such a key switch control device which is capable of regulating and memorizing the power output of the load.

Various wall switches have been disclosed for controlling different electric home apparatus. These wall switches include: (1) a touch control switch, (2) an on/off contact switch, and (3) a rotary type light intensity regulating switch. A touch control switch provides multi-step control responsive to touching by means of a coupling capacitor. However, this kind of switch may work falsely due to the effect of static electricity, sparks at switching contact, or inductive load. An on/off contact switch is directly connected to the AC power supply for on/off control. Because an on/off contact switch is directly connected to the AC power supply, it cannot control the volume of current passing through, and tends to produce sparks when switched, causing the contacts to be melted. Furthermore, an on/off contact switch is vulnerable to moisture, causing a contact error. A rotary type light intensity regulating switch is complicated to use. When in use, the switch must be turned to the ON position, and then the rotary knob of the switch must be rotated to regulate the intensity of light of the controlled apparatus from low to high. When turning off the controlled apparatus, the rotary knob of the switch is rotated in the reversed direction to regulate the intensity of light of the controlled apparatus from high to low, and then the switch is turned to OFF position. Furthermore, this kind of switch is vulnerable to moisture, causing a contact error, and sparks tend to be produced at the contacts of the switch when operating the switch.

SUMMARY OF THE INVENTION

The present invention has been accomplished to provide a key switch control device which eliminates the aforesaid drawbacks. It is the main object of the present invention to provide a key switch control device which is capable of regulating and memorizing the power output of the load. It is another object of the present invention to provide a key switch control device which uses a single mechanical switch to achieve the control, and to prevent the occurrence of sparks during the operation. To achieve these and other objects of the present invention, there is provided a key switch control device which comprises a gate controller and a load connected in series to AC power supply, and a control circuit connected to the key switch to receive from it a pulse signal for controlling the gate controller and the load, enabling the AC power supply to be connected to the load when the key switch is clicked once, or disconnected from the load when the key switch is clicked at least twice. The control circuit comprises an oscillator which outputs a time pulse signal; a time pulse counter which receives a time pulse signal from the oscillator, and outputs a single tuned pulse signal upon receipt of a pulse signal from the key switch; a periodic comparator which receives the time pulse signal from the oscillator, and outputs a periodic square wave of a predetermined length of time upon receipt of a time pulse signal from the oscillator; a power modulation recognizer which receives and recognizes the single tuned pulse signal from the time pulse counter and a periodic wave from the periodic comparator, the power modulation recognizer outputting a pulse modulation enable signal if the length of time of the single tuned pulse signal received from the time pulse counter surpasses the length of time of the periodic wave from the periodic comparator; and an output drive which receives the single tuned pulse signal from the time pulse counter, the output drive outputting a high potential output signal to change the power output of the load, and memorizing the power modulation pulse signal upon receipt of a pulse modulation enable signal from the power modulation recognizer.

DETAILED DESCRIPTION OF THE PREFERRED EMBODIMENT

Figure 2:
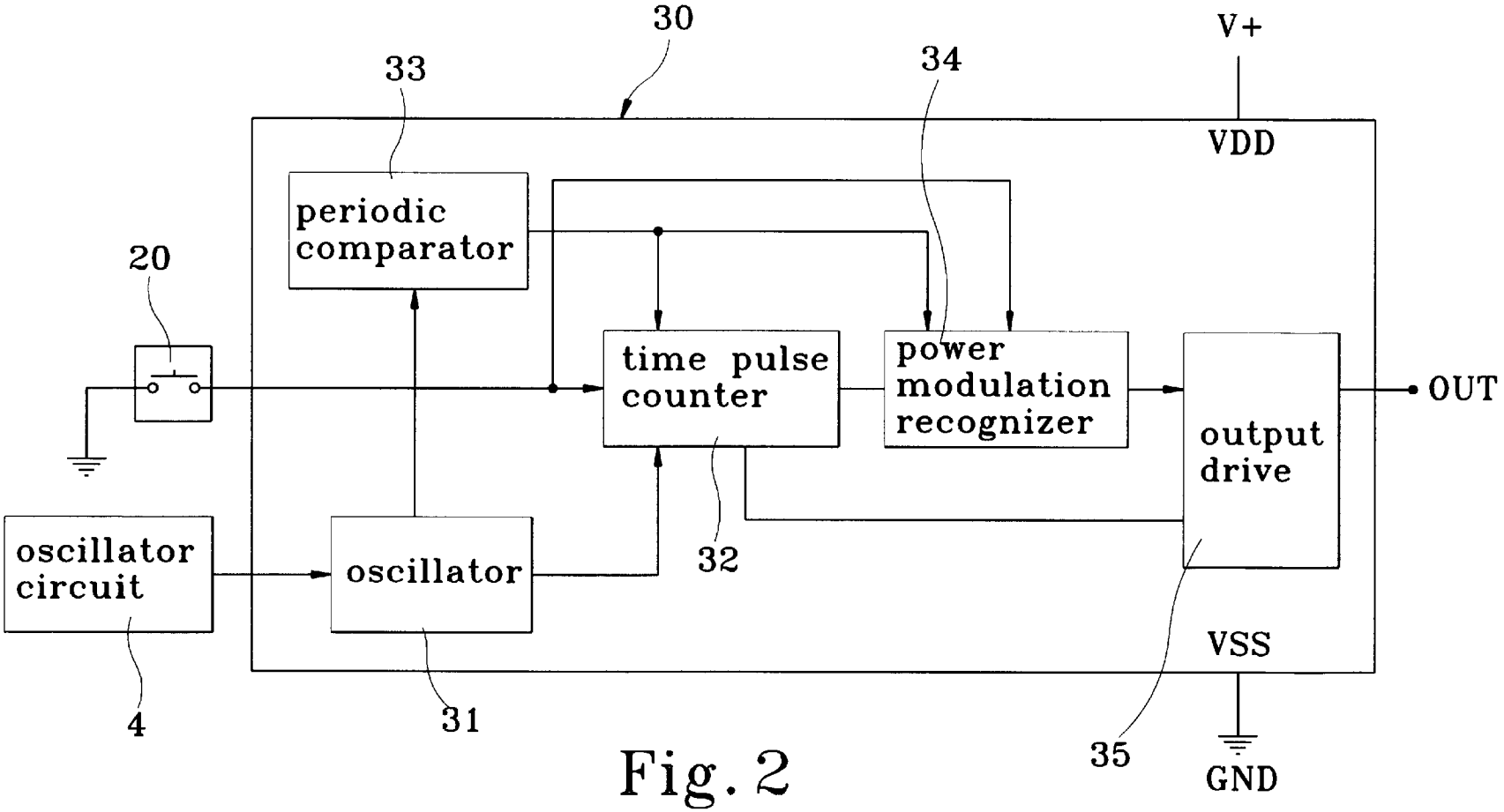
FIG. 2 is a circuit block diagram of the control circuit according to the present invention.
Figure 3:
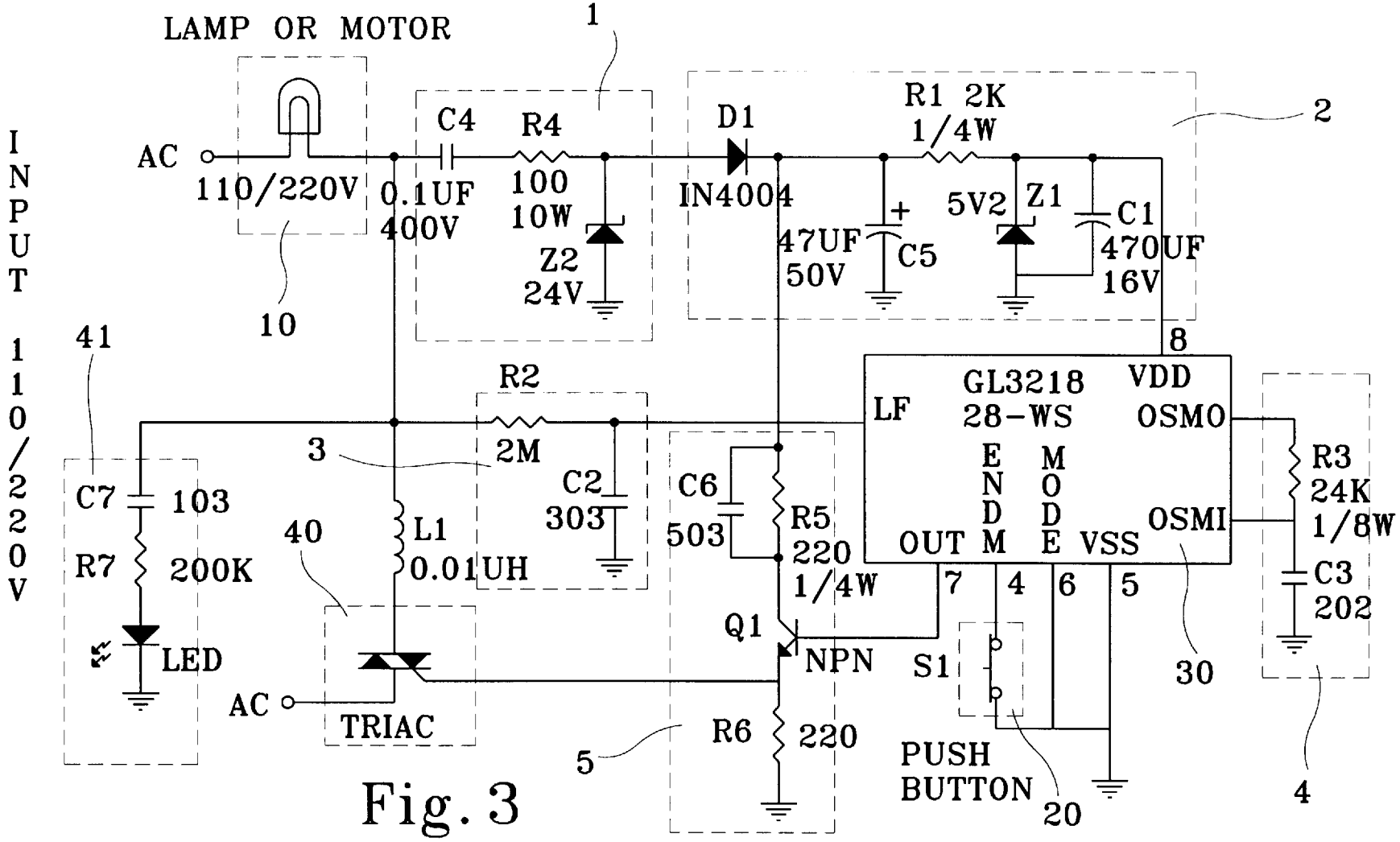
FIG. 3 is a circuit diagram of the key switch control device according to the present invention.

Referring to FIGS. 2 and 3, a control circuit 30 and a key switch 20 are electrically connected together for controlling a gate controller 40 and the load 10, that are connected in series to an AC power supply.

The control circuit 30 is comprised of an oscillator 31, a time pulse counter 32, a periodic comparator 33, a power modulation recognizer 34, and an output drive 35. The key switch 20 outputs a pulse signal when clicked, or a square wave when maintained depressed. The length of the square wave corresponds to the length of time in which the key switch 20 is maintained depressed. The oscillator 31 provides the necessary time pulse signals. The time pulse counter 32 receives a time pulse signal from the oscillator 32, and a pulse signal from the key switch 20. Upon receipt of a pulse signal from the key switch 20, the time pulse counter 32 immediately produces a single tuned pulse signal. When the key switch 20 is continuously clicked to produce a continuous series of pulse signals, the time pulse counter 32 is driven to output a plurality of single tuned pulse signals. The periodic comparator 33 receives a time pulse signal from the oscillator 31, and outputs a periodic square wave of a predetermined length of time upon receipt of a time pulse signal from the oscillator 31. The length of time of the periodic square wave can be pre-set, for example the length of time of the periodic square wave can be set for 2 seconds. The power modulation recognizer 34 receives and recognizes single tuned pulse signals from the time pulse counter 32 and the periodic wave from the periodic comparator 33. When the time pulse counter 32 outputs a first single tuned pulse signal, the periodic comparator 33 is simultaneously triggered to output a periodic wave of a predetermined length of time, and the power modulation recognizer 34 immediately outputs a low potential recognition signal upon receipt of two or more single tuned pulse signals from the time pulse counter 32 within one cycle of the periodic wave. Further, if the length of time of the square wave outputted from the key switch 20 is longer than the periodic square wave from the periodic comparator 33, the power modulation recognizer 34 outputs a pulse modulation enable signal. The output drive 35 outputs a high potential output signal upon receipt of a single tuned pulse signal from the time pulse counter 32 and a high potential recognition signal from the power modulation recognizer 34, or a low potential control signal upon receipt of a low potential recognition signal from the power modulation recognizer 34. Further, the output drive 35 outputs a power modulation pulse signal upon receipt of a pulse modulation enable signal from the power modulation recognizer 34.

The preferred embodiment of the present invention is implemented by means of an ASIC (application specific integrated circuit). The regulator circuit 1 and the rectifier filter circuit 2 are used to convert AC voltage into DC voltage for the control circuit 30. The low-pass circuit 3 is for power frequency input. The oscillator circuit 4 is the local oscillation source. The trigger circuit 5 is provided for triggering the output drive 35. The inductor L1 is for protecting the gate controller 40. The light emitting circuit 41 is for indication of the regulation of light of the key switch 20.

Figure 1:
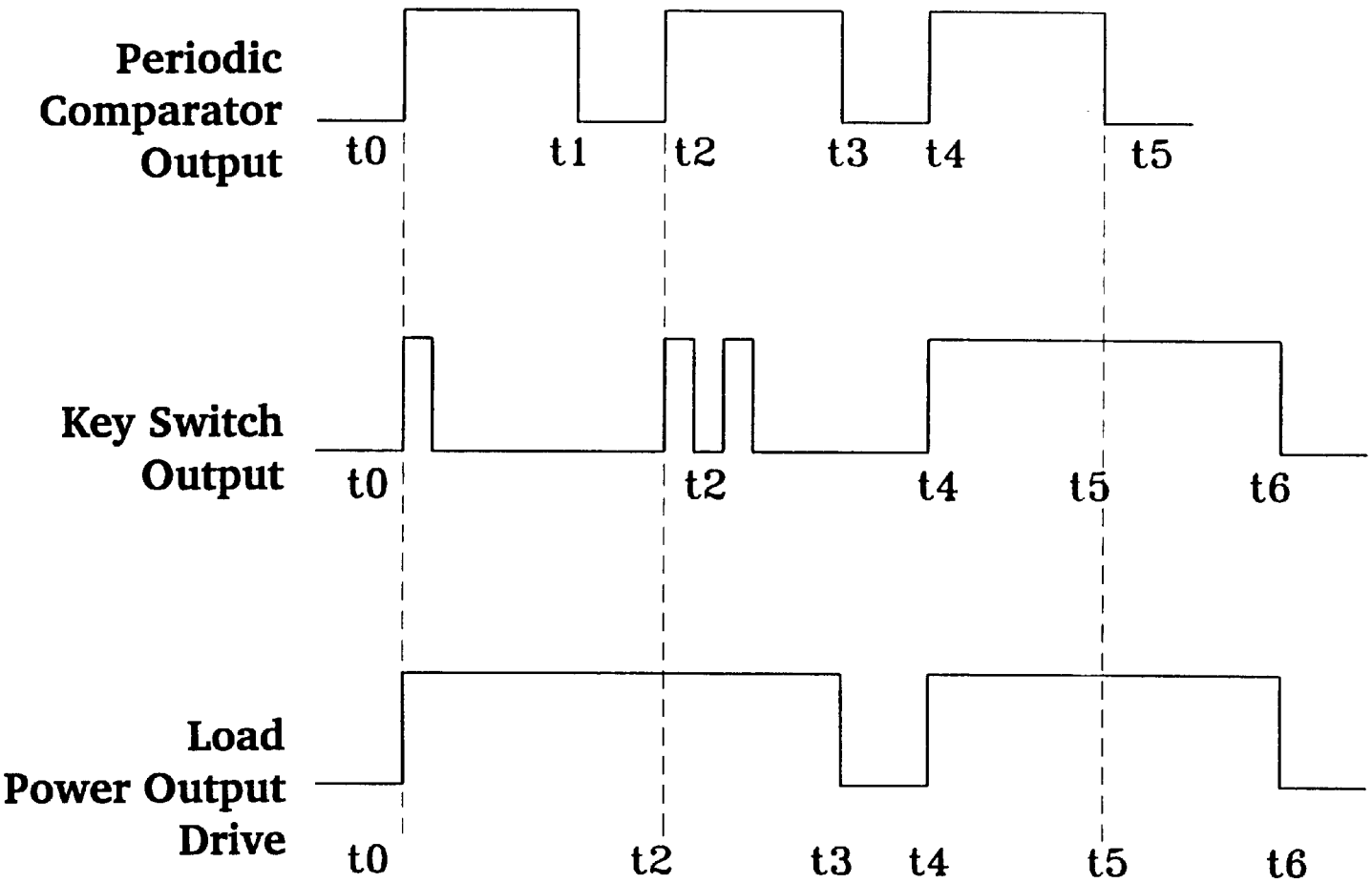
FIG. 1 is a waveform chart according to the present invention.

Referring to FIG. 1 and FIGS. 2 and 3 again, the load 10 is a light emitting element. When the key switch 20 is firstly clicked (i.e., at time frame t0), it immediately inputs a pulse into the time pulse counter 32, causing the time pulse counter 32 to output a single tuned pulse signal and the periodic comparator 33 to output a periodic square wave. The length of the periodic square wave is for example 2 seconds (i.e., the time frame from t0 to t1). At this time, the output of the load 10 is at a "ON" status. When the key switch 20 is clicked secondarily (i.e., t2), it inputs two pulses into the time pulse counter 32 within the same time cycle square wave (i.e., the time frame from t2 to t3), and the output to the load 10 is switched to an "OFF" status. Further, if the key switch 20 is continuously maintained depressed, the pulse signal input time (i.e., the time frame from t4 to t6) provided by the key switch 20 surpasses the length of time of the pre-set periodic square wave (i.e., the time frame from t4 to t5), at which time the load 10 is at an "ON" status, and the output drive 35 outputs a power modulation pulse signal. The power modulation pulse signal is controlled by an internal counter (not shown) of the output drive 35 for controlling the power output to the load 10. The counter is a 128 scale light intensity regulation counter for controlling the light intensity of the light emitting element. When the key switch 20 is released, the power modulation pulse signal is memorized by the counter, enabling the load 10 to produce the same intensity of light when turned on in the next action. When the key switch 20 is clicked on, it outputs a pulse signal to the light emitting circuit 41, the light emitting element of the light emitting circuit 41 operates subject to the condition of the key switch 20, and the light emitting element of the light emitting circuit 41 is turned on when the circuit of the key switch 20 is broken. When the key switch 20 is maintained depressed, the light intensity of the light emitting element of the light emitting circuit 41 is changed gradually from high to low. When the circuit of the key switch 20 is connected, the light emitting element of the light emitting circuit 41 becomes dark.

The ON/OFF operation definition of the key switch control device can be changed subject to a change of ASIC application function. The aforesaid time pulse counter 32 comprises a set line. If the output signal of the set line is (1,1), AC power supply is connected to the load 10 when the key switch 20 is clicked, or disconnected from the load 10 when the key switch 20 is clicked twice within one periodic wave. If the output signal of the set line is (1,0), AC power supply is connected to (or disconnected from) the load 10 when the key switch 20 is firstly clicked, or disconnected from (or connected to) the load 10 when the key switch 20 is clicked again. If the output signal of the set line is (0,0), the user is allowed to set the connection or disconnection status of the key switch 20. The aforesaid on/off operation methods are described as follows:

| set line | On status operation mode | Off status operation mode |
|---|---|---|
| 1, 1 | click key switch once within one cycle | click key switch twice or more within one cycle |
| 1, 0 | click key switch twice or more within one cycle | click key switch once within one cycle |
| 0,1 | click key switch firstly or secondarily | click key switch secondarily or firstly |
| 0, 0 | set by the user | set by the user |

While only one embodiment of the present invention has been shown and described, it will be understood that various modifications and changes could be made thereunto without departing from the spirit and scope of the invention disclosed. Further, the invention can be employed for use in controlling the revolving speed of a fan.

What the invention claimed is:

1. A key switch control device comprising a gate controller and a load connected in series to an AC power supply, a control circuit connected to a key switch to receive from said key switch a pulse signal for controlling said gate controller and said load, enabling said AC power supply to be connected to said load when said key switch is clicked once, or disconnected from said load when said key switch is clicked at least twice, wherein said control circuit comprises:

an oscillator which outputs time pulse signals;

a time pulse counter which receives said time pulse signals from said oscillator, and outputs a plurality of tuned pulse signals upon receipt of said pulse signal from the key switch;

a periodic comparator which also receives said time pulse signals from said oscillator, and outputs a periodic square wave of a predetermined length of time upon receipt of one of said time pulse signals from said oscillator;

a power modulation recognizer which receives and recognizes said plurality of tuned pulse signals from said time pulse counter and said periodic square wave from said periodic comparator, said power modulation recognizer outputting a high potential recognition signal when said time pulse counter outputs a first of said plurality of tuned pulse signals and said periodic comparator is triggered to output said periodic square wave of said predetermined length of time, said power modulation recognizer outputting a low potential recognition signal upon receipt of said plurality of said tuned pulse signals from said time pulse counter within one cycle of the periodic square wave from said periodic comparator; and an output drive which receives said plurality of tuned pulse signals from said time pulse counter, said output drive outputting a high potential output signal upon receipt of one of said plurality of tuned pulse signals from said time pulse counter and said high potential recognition signal from said power modulation recognizer, or said low potential control signal upon receipt of said low potential recognition signal from said power modulation recognizer.

2. The key switch control device of claim 1, wherein said time pulse counter comprises a set line to which are output a first output signal, a second output signal or a third output signal; said AC power supply is connected to said load when said key switch is clicked or disconnected from said load when said key switch is clicked twice while one said periodic square wave is being output and the first output signal is output to said set line; said AC power supply is connected to said load when said key switch is firstly clicked or disconnected from said load when said key switch is clicked again and the second output signal is output to said set line; and a user is allowed to set a connection or disconnection status of said key switch when the third output signal is output to said set line.

3. The key switch control device of claim 1, wherein said gate controller is controlled by said control circuit through a trigger circuit; said gate controller is a TRIAC.

4. The key switch control device of claim 3, wherein said trigger circuit comprises a DIAC for triggering said gate controller, causing said gate controller to connect said power supply with said load.

5. The key switch control device of claim 3, wherein said trigger circuit comprises a transistor for triggering said gate controller, causing said gate controller to connect said power supply with said load.

6. The key switch control device of claim 3, wherein said trigger circuit comprises a capacitor for triggering said gate controller, causing said gate controller to connect said power supply with said load.

7. A key switch control device comprising a gate controller and a load connected in series to an AC power supply, a control circuit connected to a key switch to receive from said key switch a pulse signal for controlling said gate controller and said load, enabling said AC power supply to be connected to said load when said key switch is clicked once, or disconnected from said load when said key switch is clicked at least twice, wherein said control circuit comprises:

an oscillator which outputs time pulse signals;

a time pulse counter which receives said time pulse signals from said oscillator, and outputs a plurality of tuned pulse signals upon receipt of said pulse signal from the key switch;

a periodic comparator which receives said time pulse signals from said oscillator, and outputs a periodic square wave of a predetermined length of time upon receipt of one of said time pulse signals from said oscillator;

a power modulation recognizer which receives and recognizes said plurality of tuned pulse signals from said time pulse counter and said periodic square wave from said periodic comparator, said power modulation recognizer outputting a pulse modulation enable signal when the length of time of one of the plurality of tuned pulse signals received from said time pulse counter surpasses the predetermined length of time of the periodic square wave from said periodic comparator; and an output drive which receives said plurality of tuned pulse signals from said time pulse counter, said output drive outputting a high potential output signal to change the power output of said load, and outputting a power modulation pulse signal upon receipt of said pulse modulation enable signal from said power modulation recognizer.

* * * * *